United States Patent [19]

Sorensen

[11] Patent Number: 4,776,067

[45] Date of Patent: Oct. 11, 1988

[54] CABLE TIE

[76] Inventor: Jens O. Sorensen, P.O. Box 2274, Rancho Santa Fe, Calif. 92067

[21] Appl. No.: 15,776

[22] Filed: Feb. 17, 1987

[30] Foreign Application Priority Data

Feb. 17, 1986 [GB] United Kingdom ..... 8603892
Aug. 12, 1986 [GB] United Kingdom ..... 8619598

[51] Int. Cl.[4] ..... B65D 63/00
[52] U.S. Cl. ..... 24/16 PB; 24/17 AP
[58] Field of Search ..... 24/16 PB, 17 AP, 30.5 P, 24/543; 292/321, 322

[56] References Cited

U.S. PATENT DOCUMENTS

| | | | |
|---|---|---|---|
| 3,224,056 | 12/1965 | Joffe | 24/16 PB |
| 3,457,598 | 7/1969 | Mariani | 24/16 |
| 3,486,201 | 12/1969 | Bourne | 24/16 |
| 3,581,347 | 6/1971 | Verspieren | 24/16 |
| 3,660,869 | 5/1972 | Caveney et al. | 24/16 PB |
| 3,761,999 | 10/1973 | Morgan | 24/16 PB |
| 3,924,299 | 12/1975 | McCormick | 24/16 |
| 3,965,538 | 6/1976 | Caveney et al. | 24/16 |
| 3,973,292 | 8/1976 | Bonnet | 24/16 PB |
| 4,001,898 | 1/1977 | Caveney | 24/16 |
| 4,473,524 | 9/1984 | Paradis | 264/291 |
| 4,532,679 | 8/1985 | Scott | 24/16 |
| 4,631,782 | 12/1986 | Gecs | 24/17 AP |

FOREIGN PATENT DOCUMENTS

| | | | |
|---|---|---|---|
| 2555677 | 5/1985 | France . | |
| 2360992 | 7/1974 | Fed. Rep. of Germany | 24/16 PB |
| 2717622 | 10/1978 | Fed. Rep. of Germany | 24/16 PB |
| 516134 | 7/1976 | U.S.S.R. | 24/16 PB |
| 1287587 | 8/1972 | United Kingdom . | |
| 1287588 | 8/1972 | United Kingdom . | |
| 1287589 | 8/1972 | United Kingdom . | |
| 1426368 | 2/1976 | United Kingdom . | |
| 1575128 | 9/1980 | United Kingdom . | |
| 2135382 | 8/1984 | United Kingdom . | |

*Primary Examiner*—Victor N. Sakran
*Attorney, Agent, or Firm*—Edward W. Callan

[57] ABSTRACT

A self-locking tie for tying bundles of articles such as cables has an elongated tongue with ratchet teeth on one face and one end of which may be passed through a locking head at the other end of the tongue to form a closed loop about matter being tied with the ratchet teeth on the outside of the loop. The locking head includes a resilient pawl for engaging the tongue and holding it between the pawl and an opposed abutment surface against release. In addition, on the same side of the locking head as the pawl, the locking head includes a plurality of fixed teeth engageable by the tongue ratchet teeth. On insertion of the tongue and first tightening thereof, any tension in the tongue on release of the tightening force is taken by the pawl either alone or together with the fixed teeth. However, on increased tightening of the tie to squeeze the matter being tied and upon release of the increased tightening force, the forces of the matter being tied in reaction to the squeezing of the tie cause the angle of the tongue about the locking head to change whereby the tongue is urged into tight engagement with the fixed teeth so that the retention of the tongue in the locking head is effected mainly by the fixed teeth relieving the loading upon the pawl.

7 Claims, 4 Drawing Sheets

CABLE TIE

This invention relates to a self-locking cable tie for tying bundles of articles such as cables.

A conventional cable tie comprises a flexible elongate tongue having a head at one end with an opening dimensioned to receive the other end of the tongue so as to retain a bundle of cables or the like. The tongue includes a plurality of lateral tongue ratchet teeth and the head includes co-operating ratchet teeth in the opening so that, on insertion of the free end of the tongue into the opening in the head and tightening, the tongue is locked against release. The ratchet teeth in the head were initially fixed. However, as this made it difficult to insert the tongue into the opening, the ratchet teeth on the head in more recent table ties tend to be normally positioned on a resilient pawl such as disclosed in U.S. Pat. No: 3,660,869. However, there are several problems with existing cable ties:

(i) in most cable ties the ratchet teeth on the tongue are disposed on the inside of the tie in use. On tightening with the conventional tightening hand tool extreme pressure is exerted which causes the teeth to cut into the cables or like being tied;

(ii) the resilient pawl can be damaged when force is applied to the tie because the strength of the pawl is a compromise between strength and the need for the pawl to flex sufficiently to allow easy insertion. Pawls of a different material, e.g. metal, have been proposed but are unacceptably expensive; and (iii) fixed teeth arrangements are unsatisfactory because the fact that there is no resilience means that, if the bundle contracts for any reason, the bundle could become loose since the tongue could release from the head.

An attempt at improving the locking of a cable tie is disclosed in U.S. Pat. No: 3,924,299 where a transverse ridge is provided on the abutment face opposed to the pawl so that in use the pawl acts to bend the tongue over the ridge so as to provide a lock additional to the simple pressure of the tongue against the abutment surface. In one arrangement further grip is obtained by additionally providing the abutment surface with a plurality of projections which are engageable with grooves on the tongue. These grooves are provided on the opposite side of the tongue to the tongue ratchet teeth and are spaced equally with respect to the spacing of the projections on the abutment surface. However, this arrangement still presents problems, for example:

(a) where grooves are provided on the tongue in addition to the tongue ratchet teeth either the tongue needs to be thicker, which will use more material, or the tongue will be weakened;

(b) the tie is primarily dependent upon the push of the pawl to push the free end of the tongue over the transverse ridge; and (c) where the abutment surface is provided with projections the shape of the projections is such that the tension on the pawl is not significantly reduced.

The object of the present invention is to provide an improved tie.

According to the present invention there is provided a tie for forming a loop for retaining a bundle of cables or the like comprising: an elongated tongue with a locking head at one end, first locking means along one face of the tongue, an opening in the locking head adapted to receive the other end of the tongue, second locking means at one side of the locking head, and an abutment surface at the opposite side of the locking head, the first and second locking means, in use, being co-operable to lock the tongue in position against the abutment surface under applied load when the tongue is inserted through the opening with the first locking means on the outside of the loop characterised in that the second locking means includes, in the direction of insertion of the tongue through the opening and on said one side of the locking head, fixed holding means and, downstream thereof, movable holding means.

The invention also includes a tie comprising a locking head having an opening therethrough, a first holding means in the form of a resilient pawl on one side of the opening, an abutment surface on the locking head opposite to the first holding means, an elongate tongue extending from the locking head adjacent the abutment surface, and a plurality of tongue ratchet teeth on one face of the tongue, the free end of the tongue being passable through the opening in the locking head to form a closed loop about matter being tied with the tongue ratchet teeth on the outside of the loop characterised in that the tie further includes second holding means on said one side opposite to the abutment surface, the arrangement being such that, on insertion of the tongue and first tightening thereof any tension in the tongue on release of the tightening force is taken by the first holding means either alone or together with the second holding means and, on increased tightening of the tie to squeeze the matter being tied and upon release of the increased tightening force, the forces of the matter being tied in reaction to the squeezing of the tie cause the angle of the tongue about the locking head to change whereby the tongue is urged into tight engagement with the second holding means so that the retention of the tongue in the locking head is effected mainly by the second holding means.

Preferably the second holding means includes a plurality of ratchet teeth which lie on a curve on the locking head and the spacing between adjacent teeth on the locking head is slightly greater than the spacing between the adjacent teeth on the tongue.

According to a further aspect of the invention a tie for forming a loop for retaining a bundle of cables or the like comprising an elongated tongue with a locking head at one end, the locking head comprising an opening for receiving the other end of the tongue to form the loop, the tongue comprising ratchet teeth on the face of the tongue which is on the outside of the loop, first holding means comprising a movable pawl adjacent the opening of the locking head with at least one pawl ratchet tooth thereon and second holding means comprising at least one fixed ratchet tooth adjacent the opening of the locking head characterised in that both the movable pawl with its ratchet tooth and the fixed ratchet tooth are located at the opposed side of the head to the attachment of the tongue and both the ratchet tooth on the movable pawl and the fixed ratchet tooth are interengageable with the ratchet teeth on the face of the tongue on the outside of the loop.

The invention will now be described by way of example such reference to the accompanying diagrammatic drawings in which.

Figure 1:
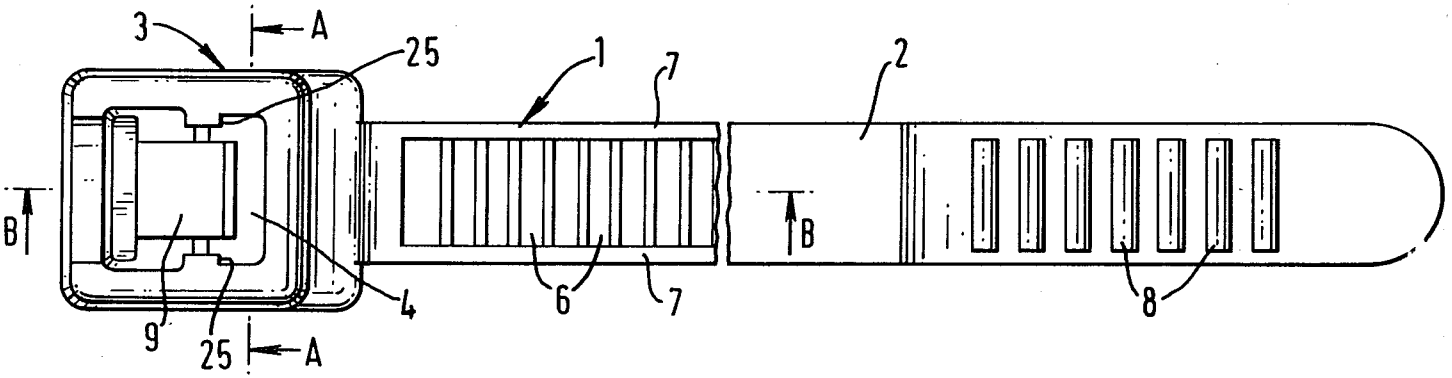
FIG. 1 is a plan view of a preferred cable tie.
Figure 2:
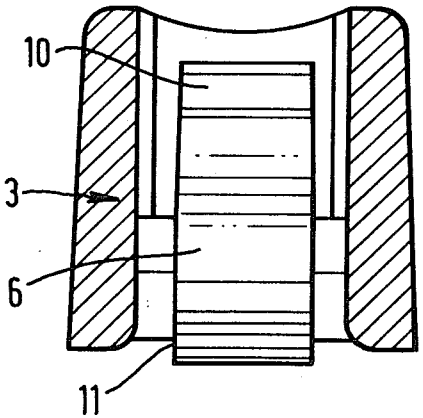
FIG. 2 is a sectional view on A—A in FIG. 1.
Figure 3:
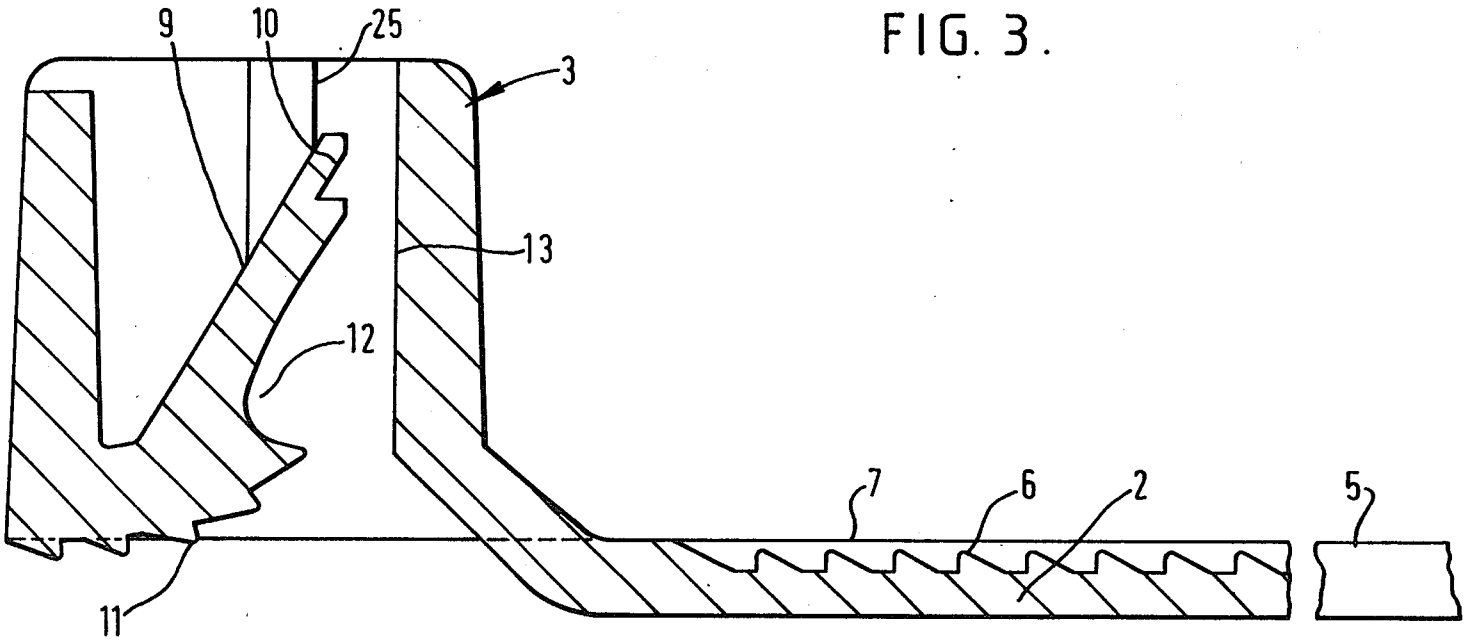
FIG. 3 is a cross-section on B—B in FIG. 1.

In the drawings a cable tie 1 comprises a flexible elongated tongue 2 having a locking head 3 at one end. The locking head 3 has an opening 4 through it which defines an insertion direction for the other end of the tongue 2 which is substantially perpendicular to the initial direction of extension of the tongue 2 away from the head 3. The opening 4, as seen from FIG. 1, is dimensioned closely to the cross-sectional configuration of the tongue 5 and includes lateral guide shoulders 25 at its upper end. The tongue 2 has an outer face 5 (FIG. 3) with a plurality of lateral tongue ratchet teeth 6 which extend between smooth side sections 7 of the tongue 2. The teeth 6 extend substantially perpendicular to the plane of the tongue 2 to ensure firm locking as can be seen particularly from FIG. 3. In use, the smooth side sections 7 about the guide shoulders 25. The free end of the tongue 2 is provided with raised ribs 8 to aid in manipulation during securing of the tie. The locking head 3 is formed with two holding means in the form of a movable holding means comprising a resilient pawl 9 having pawl ratchet teeth 10, and a fixed holding means consisting of fixed ratchet teeth 11 lying on a curve about the outer entrance edge of the opening 4.

The direction of the fixed ratchet teeth 11 are not parallel and lie on a curve as shown. Preferably, the distance between the fixed ratchet teeth 11 is slightly greater than the distance between the tongue ratchet teeth 6 which enables the loading to be spread as will be explained.

Figure 4:
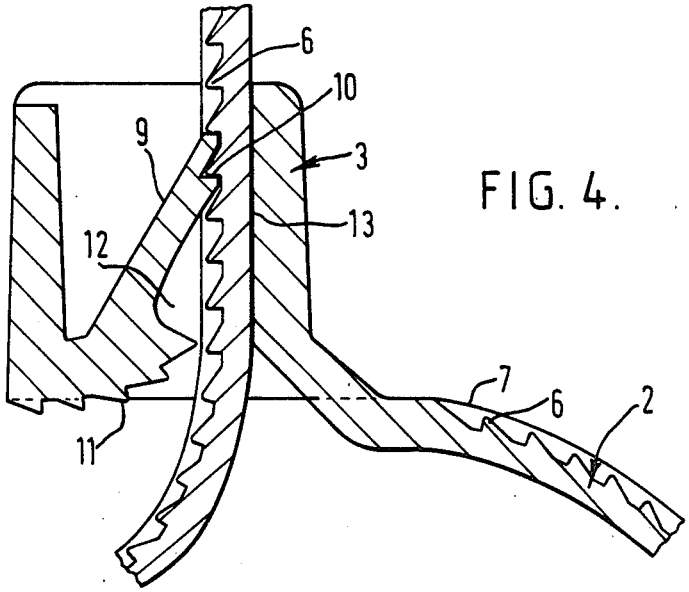
FIG. 4 is a partial diagrammatic cross-section of the tie in a lightly locked position.
Figure 5:
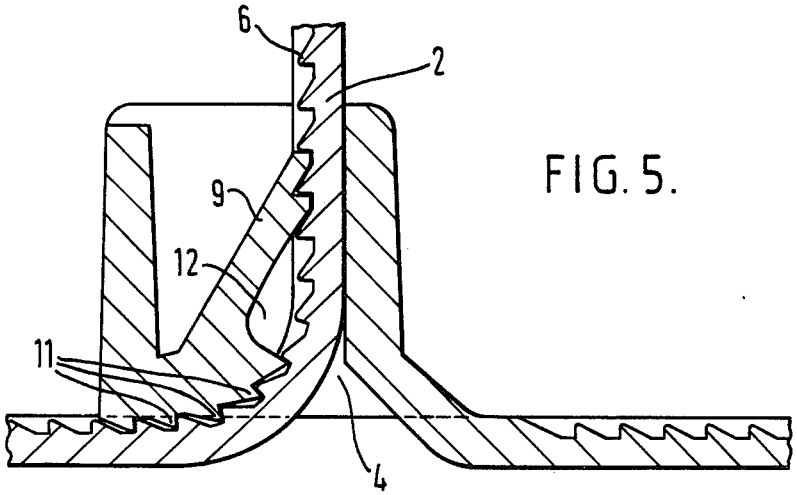
FIG. 5 is a view similar to that of FIG. 4 but under increased applied load.
Figure 6:
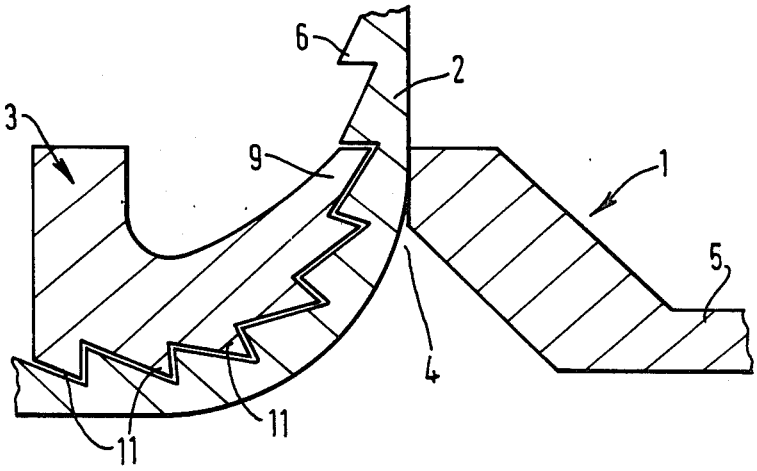
FIG. 6 is partial diagrammatic cross-sectional view of a modified embodiment under applied load.

In the first embodiment of FIGS. 1 to 5 the pawl 9 includes a waisted portion 12 where the pawl 9 hinges in use defining the transition between the movable and fixed teeth. However, as illustrated in FIG. 6 the pawl teeth 10 may merge uniformly into the fixed teeth 11. Both the pawl teeth 10 and the fixed teeth 11 are disposed on the same side of the opening 4 opposite an abutment surface 13 and in use the free end of the tongue 2 is trapped between the pawl 9 and the abutment surface 13 (see FIGS. 4 to 6).

In use the tie 1 is positioned with the tongue ratchet teeth 6 on the outside. The free end of the tongue 2 is then inserted through the opening 4 pushing the flexible pawl 9 to one side. Under light loading the tongue 2 is retained by interengagement between the pawl teeth 10 and the tongue ratchet teeth 6 forcing the tongue 2 to be trapped against the abutment surface 13 (FIG. 4). As the tension on the tongue 2 is increased and then released, the squeezing of the bundle being tied generates reaction forces in the bundle which urges the tongue ratchet teeth 6 into firm engagement with the fixed ratchet teeth 11 as shown in FIGS. 5 and 6 and thereby relieves the loading on the pawl 9. Moreover, as the distance between the fixed teeth 11 is slightly greater than between the tongue ratchet teeth 6, the loading of the fixed teeth 11 is sequential i.e. as the tension increased the fixed tooth closest to the pawl 9 takes the loading then, just as that tooth has taken as much tension as it can the next fixed tooth is engaged and so on so that the loading is spread across the fixed teeth.

In the preferred arrangement of cable tie, in use, both the movable holding means in the form of the pawl 9 and the fixed holding means ultimately engage the tongue 2 against release. Thus, on insertion of the tongue and first tightening, any tension in the tongue on release of the tightening force is taken primarily by the pawl. However, on increased tightening of the tie to squeeze the matter being tied and release of the increased tightening force, the forces of the matter being tied in reaction to the squeezing of the tie urge the tongue into tight engagement with the fixed holding means. In this way the proportion of the tension taken by the stronger fixed holding means increases relative to the tension taken by the weaker movable holding means as the tension increases.

Thus the tie of the present invention provides both fixed and movable teeth on the same side of the locking head opposite to the side from which the tongue extends. Neither of these work satisfactorily on their own but, in combination, they rely upon one another to provide a tie with improved performance characteristics. The movable pawl holds the tongue in position at low load and then, if more strength is required, it serves to guide the tongue into firm engagement with the fixed teeth.

The tie of the present invention therefore has several advantages:

(a) because the tension is shared with the fixed teeth the flexible pawl may be more flexible than before to provide ease of insertion and yet may take increased tension;

(b) the provision of fixed teeth means that the tension can be increased as much as need be practical without damaging the pawl; and (c) the tongue ratchet teeth are disposed on the outside in use so that there is no danger of damage to the cables or the like being tied.

The cable tie of the present invention is preferably NYLON 6-6 (trade mark) or it could be polypropylene. Although the specification refers generally to the inclusion of two holding means, one movable and one fixed, it will be understood that the term "fixed" in the context of the specification means less movable than the movable pawl. Moreover, as clearly indicated in FIG. 6, the movable holding means and the fixed holding means may merge into one another with no clear demarcation between the two holding areas.

I claim:

1. A tie for forming a loop for retaining a bundle of cable-like articles, comprising an elongated tongue with an adjacent locking head at one end and with locking means extending along one side of the tongue;

wherein the locking head defines an opening for receiving the other end of the tongue to form said loop and includes an abutment surface interior to said opening and on the side of said opening defined by the side of the locking head that is adjacent the tongue;

movable holding means interior to and on the opposite side of said opening, with the movable holding means being disposed for engaging the locking means of the tongue and for forcing the other side of the tongue against the abutment surface to thereby hold the tongue in the locking head after the other end of the tongue has been inserted through said opening with the one side of the tongue facing the movable holding means, and with the movable holding means being movable in response to pressure applied by the tongue as the tongue is being so inserted in order to ease the passage of the tongue through said opening as the other end of the tongue is being so inserted; and second holding means on the opposite side of said opening and adjacent the insertion end of said opening, and disposed at a different angle than the movable holding means for engaging said locking means on the one side of the tongue on a portion of the tongue that is bent at an angle away from the abutment surface by said bundle of articles when the other end of the tongue is inserted a sufficient distance to tighten said loop around said bundle to thereby increase the holding force applied to the tongue by the locking head when said loop has been tightened.

2. A tie according to claim 1, wherein the locking means, the movable holding means and second holding means comprise co-operable ratchet teeth.

3. A tie according to claim 2, wherein the second holding means comprises a plurality of fixed ratchet teeth on the locking head, with the spacing between adjacent teeth of the second holding means being slightly greater than the spacing between the adjacent teeth of the first locking means on the tongue.

4. A tie according to claim 3, wherein the teeth of the second holding means are not in a single plane.

5. A tie according to claim 4 wherein the teeth of the second holding means lie on a curve.

6. A tie according to any of claims 1, 2, 3, 4 or 5, wherein the second holding means is fixed.

7. A tie according to any of claims 2, 3, 4 or 5, wherein the second holding is fixed and comprises at least two ratchet teeth disposed so that, as more tension is applied to the tie to thereby increase the angle at which the portion of the tongue retaining said bundle is bent with respect to the abutment surface, the tongue is pulled more tightly into engagement with the second holding means to engage more ratchet teeth.

* * * * *